US008260188B2

(12) United States Patent
Yahata et al.

(10) Patent No.: US 8,260,188 B2
(45) Date of Patent: Sep. 4, 2012

(54) IMAGE ERASING APPARATUS AND IMAGE ERASING METHOD

(75) Inventors: Isao Yahata, Shizuoka (JP); Takahiro Kawaguchi, Shizuoka (JP); Hiroyuki Taki, Shizuoka (JP); Ken Iguchi, Shizuoka (JP); Hiroyuki Tsuchihashi, Shizuoka (JP); Hiroyuki Taguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 149 days.

(21) Appl. No.: 12/817,081

(22) Filed: Jun. 16, 2010

(65) Prior Publication Data

US 2010/0323287 A1 Dec. 23, 2010

Related U.S. Application Data

(60) Provisional application No. 61/218,809, filed on Jun. 19, 2009, provisional application No. 61/219,600, filed on Jun. 23, 2009.

(51) Int. Cl.
*G03G 15/00* (2006.01)
*G03G 21/00* (2006.01)

(52) U.S. Cl. ..... 399/411; 399/1; 399/405

(58) Field of Classification Search ..... 399/1, 411, 399/405, 397
See application file for complete search history.

(56) References Cited

U.S. PATENT DOCUMENTS

| | | | | |
|---|---|---|---|---|
| 5,623,722 | A * | 4/1997 | Hawley et al. | 399/397 |
| RE37,197 | E * | 5/2001 | Iida et al. | 422/186 |
| 6,494,450 | B2 * | 12/2002 | Tsurumaki | 271/224 |
| 7,313,355 | B2 | 12/2007 | Isobe et al. | |
| 2008/0044213 | A1 | 2/2008 | Kato et al. | |
| 2009/0103147 | A1 | 4/2009 | Murakami | |

FOREIGN PATENT DOCUMENTS

JP 3121130 B2 12/2000

* cited by examiner

*Primary Examiner* — Sophia S Chen
(74) *Attorney, Agent, or Firm* — Patterson & Sheridan, LLP

(57) ABSTRACT

An image erasing apparatus includes a stacking tray stacking the recording medium, a heater heating the recording medium to a temperature equal to or higher than the temperature at which developer on the recording medium is erased, a detector disposed downstream in a recording medium carrying direction from the heater to detect an image on the recording medium, a recording medium carrying mechanism picking up the recording medium, from the stacking tray sheet by sheet and carrying the picked-up recording medium, a storage box storing the image-erased recording medium by size, a lateral aligning mechanism disposed in the storage box so as to align the recording medium in the lateral direction, and a controller controlling the alignment operation of the lateral aligning mechanism.

22 Claims, 4 Drawing Sheets

IMAGE ERASING APPARATUS AND IMAGE ERASING METHOD

CROSS-REFERENCE TO RELATED APPLICATIONS

This application is based upon and claims the benefit of priority from the prior the U.S. Patent Application No. 61/219,600, filed on Jun. 23, 2009, and the prior the U.S. Patent Application No. 61/218,809, filed on Jun. 19, 2009 and the entire contents of which are incorporated herein by reference.

FIELD

The present invention relates to an image erasing apparatus erasing an image of a recording medium on which the image is formed with erasable developer.

BACKGROUND

In recent years, with the demand for saving resources, an image forming apparatus forming an image with erasable developer and an image erasing apparatus were introduced. This image erasing apparatus erases an image by applying heat or light to a recording medium on which the erasable developer forms an image to erase the developer. Accordingly, the erased recording medium can be reused.

Here, the image-erased recording mediums are received in a storage box. Since the recording medium was used once, the recording medium may be curled. An alignment mechanism is necessary for regularly receiving the recording mediums.

As an example of the conventional alignment mechanism, a technique of providing an alignment mechanism for a process tray or a discharge tray as a sheet post-processing device is suggested.

DETAILED DESCRIPTION

Throughout this description, the embodiments and examples shown should be considered as exemplars, rather than limitations on the apparatus and methods of the present invention.

Hereinafter, an image erasing apparatus and an image erasing method according to an embodiment of the invention will be described in detail with reference to the accompanying drawings.

An image erasing apparatus erasing an image on a recording medium, includes: a stacking tray stacking the recording medium; a heater heating the recording medium to a temperature equal to or higher than the temperature at which developer on the recording medium is erased; a detector disposed downstream in a recording medium carrying direction from the heater to detect an image on the recording medium; a recording medium carrying mechanism picking up the recording medium from the stacking tray sheet by sheet and carrying the picked-up recording medium; a storage box storing the image-erased recording medium by size; a lateral aligning mechanism disposed in the storage box so as to align the recording medium in the lateral direction; and a controller controlling the alignment operation of the lateral aligning mechanism.

Configuration of Image Erasing Apparatus

Figure 1:
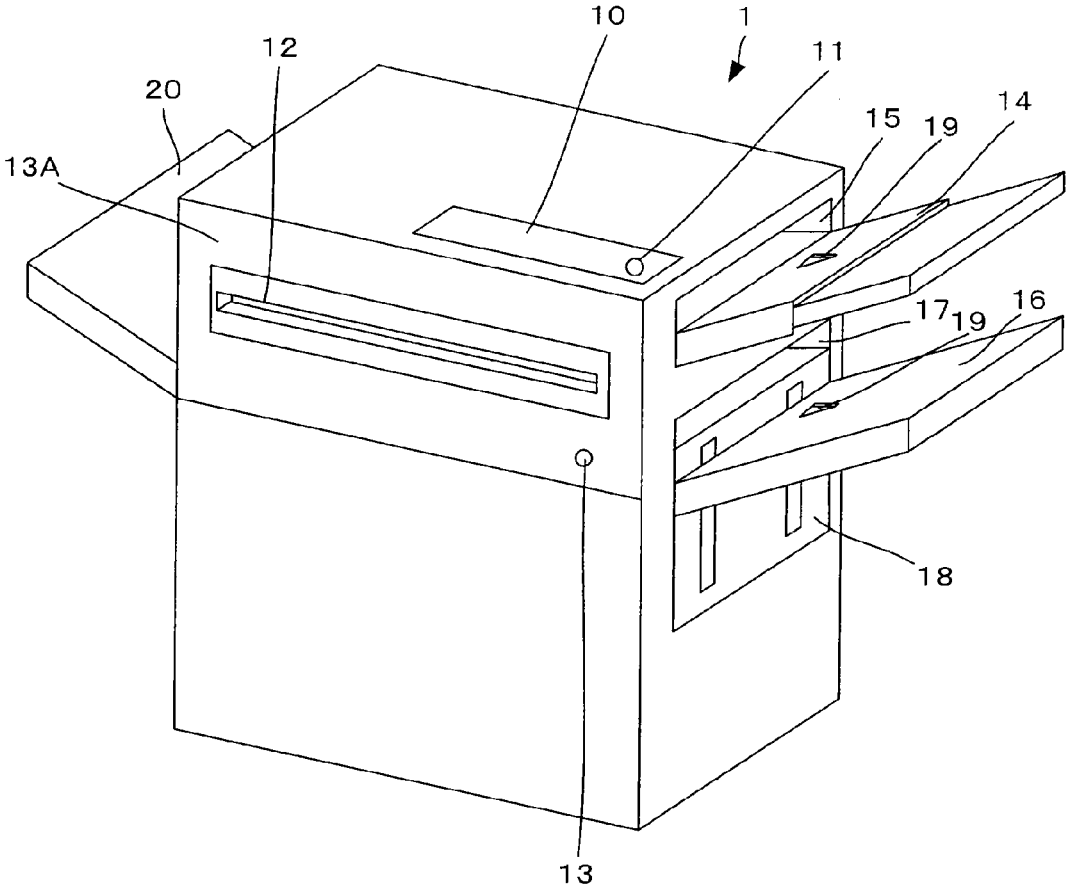
FIG. 1 is a perspective view illustrating an appearance of an image erasing apparatus according to an embodiment of the invention.

FIG. 1 is a perspective view illustrating the appearance of the image erasing apparatus 1. As shown in FIG. 1, the image erasing apparatus 1 includes a control panel 10 which is an input and output device on the top surface of a main body, a start button 11 for instructing the input of a secret document, an inlet 12 of a security box 30 to be described later, and a door key 13 limiting the opening of the security box 30.

The image erasing apparatus 1 further includes an interrupt tray 14 which is foldable, an interrupt reception port 15 receiving a recording medium from the interrupt tray 14, and a recording medium sensor 19 disposed on the top of the interrupt tray.

The image erasing apparatus 1 further includes a stacking tray 16 for stacking recording mediums from which images are erased, a recording medium sensor 19 disposed on the top surface of the stacking tray 16, a stacking tray lifting and lowering mechanism 18 lifting and lowering the stacking tray 16, and a reception port 17 for receiving a recording medium from the stacking tray 16.

The image erasing apparatus 1 further includes a sheet discharge tray 20 for stacking recording mediums from which images are erased.

The image erasing apparatus 1 receives, out of the recording mediums from which images are erased, a secret document from the inlet 12 receives normal documents stacked on the stacking tray 16 from the reception port 17, receives documents from which images should be erased by interruption while erasing an image from the interrupt reception port 15, and discharges the recording mediums from which images cannot be erased to the sheet discharge tray 20.

Figure 2:
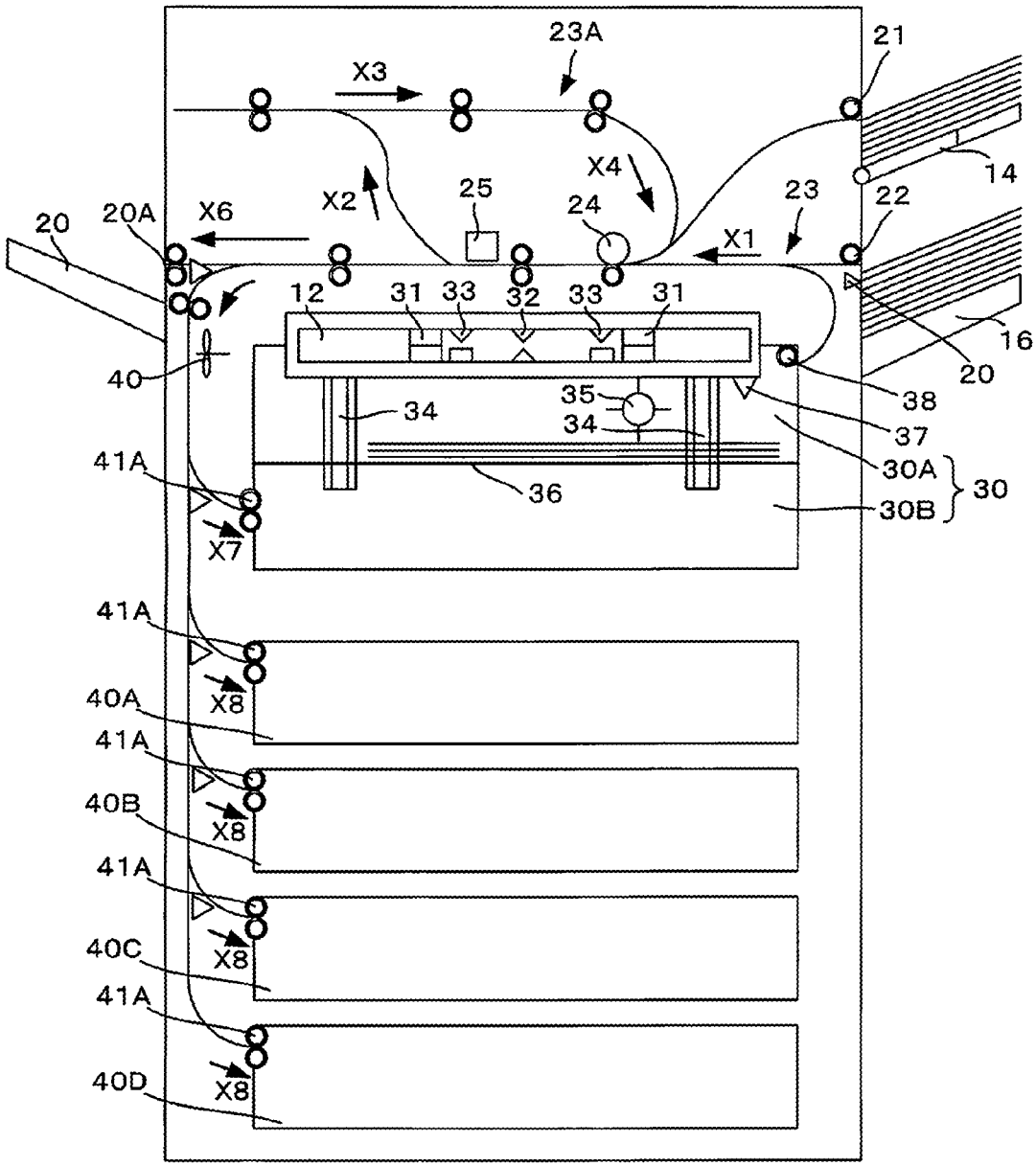
FIG. 2 is a side view illustrating a configuration of the image erasing apparatus according to the embodiment of the invention.

FIG. 2 is a side view illustrating the configuration of the image erasing apparatus 1. As shown in FIG. 2, the image erasing apparatus 1 includes a recording medium carrying mechanism 23 having an inverse carrying path 23A for inverting a recording medium, a thermal head 24 as a heater heating the recording medium at a temperature equal to or higher than the erasable temperature of the developer to be erased by heat, and a scanner 25 as a detector disposed downstream in the recording medium carrying direction from the thermal head 24 and configured to detect whether an image is erased from a recording medium.

The heat source of the heater is not particularly limited as long as it can heat a recording medium to a temperature equal to or higher than an erasing temperature. For example, a halogen heater, a graphite heater, an induction heater (IH), and a roller formed of a thermally-conductive material and having a heating lamp therein can be used as the heater. In this embodiment, the thermal head 24 is exemplified as the heater, but the heater is not limited to the thermal head 24.

In the image erasing apparatus 1, an interrupt reception port roller 21 for introducing a recording medium into the recording medium carrying mechanism is disposed in the interrupt reception port 15. In the image erasing apparatus 1, a reception port roller 22 for introducing a recording medium into the recording medium carrying mechanism and a top sensor 20 for sensing a top surface of a recording medium stacked on the stacking tray 16 are disposed in the reception port 17.

In the image erasing apparatus 1, an overlap feed sensor 32 sensing the overlap feed (double feed) of recording mediums, plural size sensors 33 sensing the size of a recording medium, and an inlet roller 31 introducing a recording medium into a security box 30 are disposed in the inlet 12.

For example, an ultrasonic sensor can be used as the overlap feed sensor 32. In the overlap feed sensor 32, an ultrasonic output device is disposed above the inlet 12 and an ultrasonic sensing device is disposed below the inlet, whereby it is sensed whether a sheet of recording medium is fed or plural sheets of recording mediums are fed on the basis of an ultrasonic wave sensed by the ultrasonic sensing device.

For example, optical sensors can be used as the size sensors 33. In each size sensor 33, a light-emitting device is disposed above the inlet 12 and a light-receiving device is disposed below the inlet, whereby the size of a recording medium is detected by causing the light-receiving device to sense the interception of light from the light-emitting device by the recording medium.

In the image erasing apparatus 1, a movable tray 36 on which a recording medium input from the inlet 12 is placed, a movable tray lifting and lowering mechanism 34 lifting and lowering the movable tray 36, an alignment paddle 35 aligning the recording mediums placed on the movable tray 36 in the recording medium carrying direction, a movable tray top sensor 37 sensing the top surface of a recording medium placed on the movable tray 36, and a pickup roller 38 picking up the recording mediums on the movable tray 36 sheet by sheet are disposed in the security box 30.

The movable tray lifting and lowering mechanism 34 includes a belt and a driving motor. The belt is rotated with the driving force of the driving motor to lift and lower the movable tray 36.

When the image erasing apparatus 1 receives an instruction to receive a recording medium from the inlet 12 from the start button 11, the movable tray 36 is lifted down and the alignment paddle 35 is rotated. When the reception of a recording medium is ended and an image is erased therefrom, the movable tray 36 is lifted up until the movable tray top sensor 37 senses the top surface of the recording medium, and the pickup roller 38 feeds the recording mediums to the recording medium carrying mechanism 23 sheet by sheet.

When the overlap feed sensor 32 senses the overlap feed of recording mediums or when the size sensors 33 sense the input of a recording medium having a size other than set target sizes, the image erasing apparatus 1 rotates the inlet roller 31 backwardly to discharge the recording medium and displays an error message on the control panel 10.

In the image erasing apparatus 1, the security box 30 is partitioned into an upper box 30A and a recovery box 30B by the use of the movable tray 36. That is, the image erasing apparatus 1 includes the recovery box 30B for storing recording mediums below the movable tray 36. The image erasing apparatus 1 includes an input roller 41A for inputting a recording medium into the recovery box 30B.

The door key 13 limits the access to the movable tray 36 and the recovery box 30B. That is, the movable tray 36 and the recovery box 30B are covered with the door 13A. The door 13A includes the door key 13. When the door key 13 is not opened, the door 13A is not opened, and thus the recording mediums in the movable tray 36 and the recovery box 30B cannot be taken out.

The image erasing apparatus 1 includes storage boxes 40A, 40B, 40C, and 40D for storing the recording mediums, from which images are erased, by sizes. Each of the storage boxes 40A, 40B, 40C, and 40D of the image erasing apparatus 1 includes the input roller 41A.

The image erasing apparatus 1 includes a cooling fan 90 as a cooler downstream in the recording medium carrying direction from the thermal head 24 and upstream in the recording medium carrying direction from the storage boxes 90A, 40B, 40C, and 40D.

The cooling fan 40 cools the developer with viscosity increased by heat, whereby the recording mediums are prevented from being attached to each other when the recording mediums are stored on the storage boxes 40A, 40B, 40C, and 40D.

Image Erasing Operation

The image erasing apparatus 1 receives a recording medium from the interrupt reception port 15, the reception port 17, or the pickup roller 38 and carries the received recording medium in the direction of arrow X1 by the use of the recording medium carrying mechanism 23. The thermal head 24 heats the recording medium to erase the developer. The heated recording medium is carried to the scanner 25. The scanner 25 scans the recording medium to sense an image.

When an image is sensed by the scanner 25 and the recording medium is a normal document received from the interrupt reception port 15 or the reception port 17, the image erasing apparatus 1 carries the recording medium in the direction of arrow X6 by the use of the recording medium carrying mechanism 23 and discharges the recording medium to the sheet discharge tray 20 from a discharge port 20A.

When an image is sensed by the scanner 25 and the recording medium is a secret document received from the pickup roller 38, the image erasing apparatus 1 carries the recording medium in the direction of arrow X7 by the use of the recording medium carrying mechanism 23 and recovers the recording medium into the recovery box 30B.

When an image is not sensed by the scanner 25, the image erasing apparatus 1 inverts the recording medium by the use of the inverse carrying path 23A. That is, the recording medium is carried in the order of arrow X2, arrow X3, and arrow X4, thereby inverting the recording medium.

The image erasing apparatus 1 heats the inverted recording medium by the use of the thermal head 24 to erase the developer. The heated recording medium is carried to the scanner 25. The scanner 25 scans the recording medium to sense an image.

When an image is sensed by the scanner 25 and the recording medium is a normal document received from the interrupt reception port 15 or the reception port 17, the image erasing apparatus 1 carries the recording medium in the direction of arrow X6 by the use of the recording medium carrying mechanism 23 and discharges the recording medium to the sheet discharge tray 20 from the discharge port 20A.

When an image is sensed by the scanner 25 and the recording medium is a secret document received from the pickup roller 38, the image erasing apparatus 1 carries the recording medium in the direction of arrow X7 by the use of the recording medium carrying mechanism 23 and recovers the recording medium into the recovery box 30B.

That is, when the scanner 25 senses a non-erased image from at least one of the top surface and the bottom surface of the recording medium picked up from the movable tray 36, the image erasing apparatus 1 controls the recording medium carrying mechanism 23 to recover the recording medium into the recovery box 30B.

When an image is not sensed by the scanner 25, the image erasing apparatus 1 carries the recording medium in the direction of arrow X8 and distributes the recording medium to the storage boxes 40A, 40B, 40C, and 40D depending on the size of the recording medium.

Interrupt Operation

The image erasing apparatus 1 stops the image erasing operation once, when the recording medium sensor 19 of the interrupt tray 14 senses that a recording medium is stacked on the interrupt tray 14.

Then, the image erasing apparatus 1 introduces the recording medium stacked on the interrupt tray 14 from the interrupt reception port 15 sheet by sheet and performs the image erasing operation.

When the recording medium sensor 19 of the interrupt tray 14 does not sense that a recording medium is stacked on the interrupt tray 14, the image erasing apparatus 1 receives the recording medium from the reception port 17 or the pickup roller 38 and restarts the image erasing operation.

Storage Box Aligning Mechanism

Figure 3:
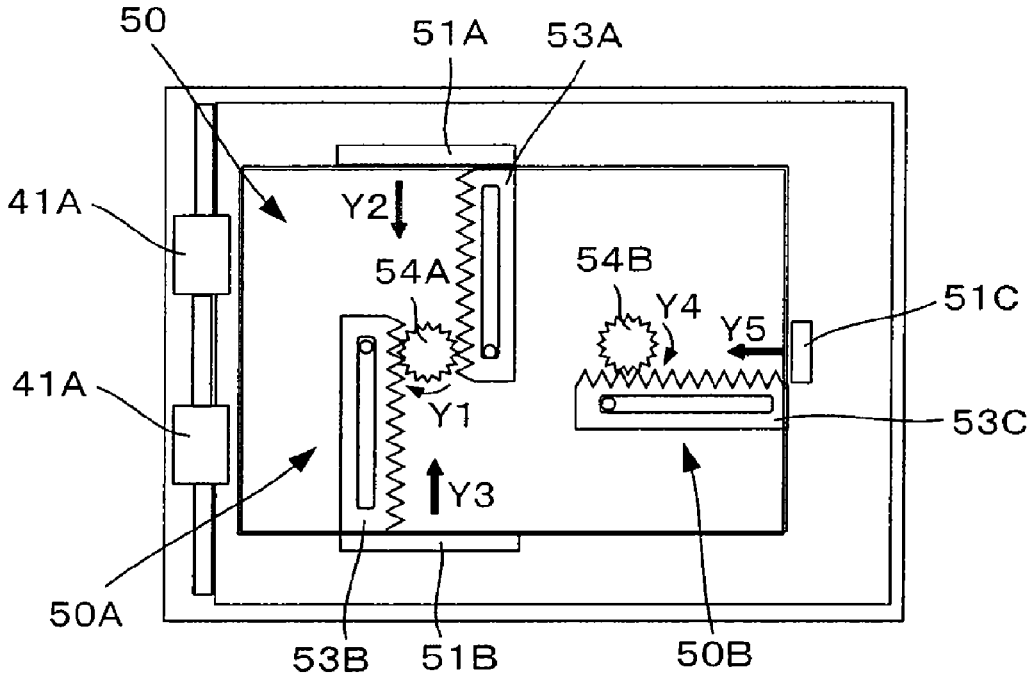
FIG. 3 is a top view of a storage box aligning mechanism according to the embodiment of the invention.
Figure 4:
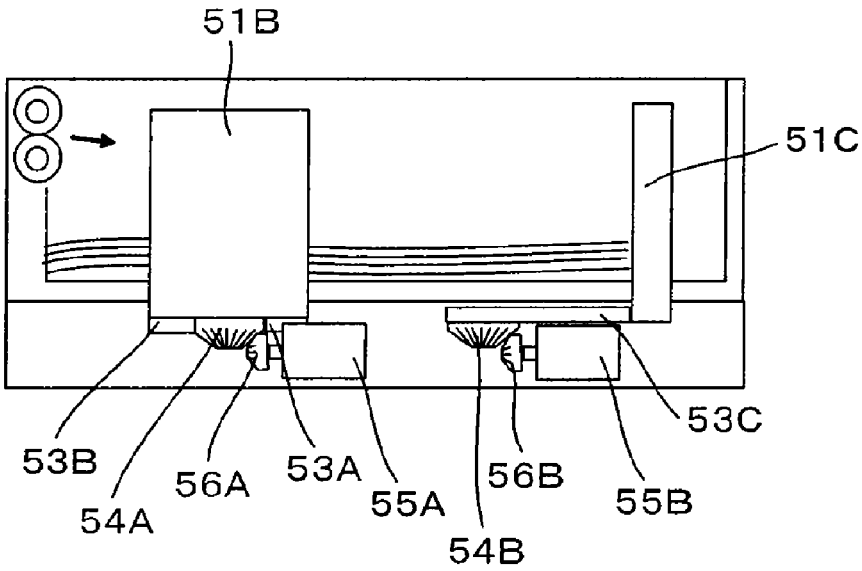
FIG. 4 is a side view of the storage box aligning mechanism according to the embodiment of the invention.

FIG. 3 is a top view illustrating the storage box aligning mechanism 50 which is disposed in the storage boxes 40A, 40B, 40C, and 40D. FIG. 4 is a side view of the storage box aligning mechanism 50.

As shown in FIGS. 3 and 4, the storage box aligning mechanism 50 includes a lateral aligning mechanism 50A aligning recording mediums in the lateral direction and a longitudinal aligning mechanism 50B aligning the recording mediums in the longitudinal direction.

The lateral aligning mechanism 50A includes a lateral aligning driving motor 55A having a gear 56A, a lateral aligning gear 54A, a first lateral aligning panel 51A connected to a first axial portion 53A having saw teeth engaging with the lateral aligning gear 54A, and a second lateral aligning panel 51B connected to a second axial portion 53B having saw teeth engaging with the lateral aligning gear 54A.

When the lateral aligning gear 54A rotates in the direction of arrow Y1, the first lateral aligning panel 51A is displaced in the direction of arrow Y2 and the second lateral aligning panel 51B is displaced in the direction of arrow Y3. In the image erasing apparatus 1, the first lateral aligning panel 51A and the second lateral aligning panel 51B are made to reciprocate by repeatedly rotating the lateral aligning gear 54A forwardly and backwardly a predetermined number of times, thereby aligning the stored recording mediums in the lateral direction.

The longitudinal aligning mechanism 50B includes a longitudinal aligning driving motor 55B having a gear 56B, a longitudinal aligning gear 54B, and a longitudinal aligning panel 51C connected to a third axial portion 53C having saw teeth engaging with the longitudinal aligning gear 54B.

When the longitudinal aligning gear 54B rotates in the direction of arrow Y4, the longitudinal aligning panel 51C is displaced in the direction of arrow Y5. The image erasing apparatus 1 causes the longitudinal aligning panel 51C to reciprocate by repeatedly rotating the longitudinal aligning gear 54B forwardly and backwardly a predetermined number of times, thereby aligning the stored recording mediums in the longitudinal direction.

When the recording mediums are carried to the storage boxes 40A, 40B, 40C, and 40D, the first lateral aligning panel 51A, the second lateral aligning panel 51B, and the longitudinal aligning panel 51C are displaced so as to have gaps greater than the lateral width and the longitudinal width of the recording mediums, respectively.

After the recording mediums are carried to the storage boxes 40A, 40B, 40C, and 40D, the first lateral aligning panel 51A, the second lateral aligning panel 51B, and the longitudinal aligning panel 51C are displaced so as to have gaps equal to or less than the lateral width and the longitudinal width of the recording mediums, respectively.

Control System of Image Erasing Apparatus

Figure 5:
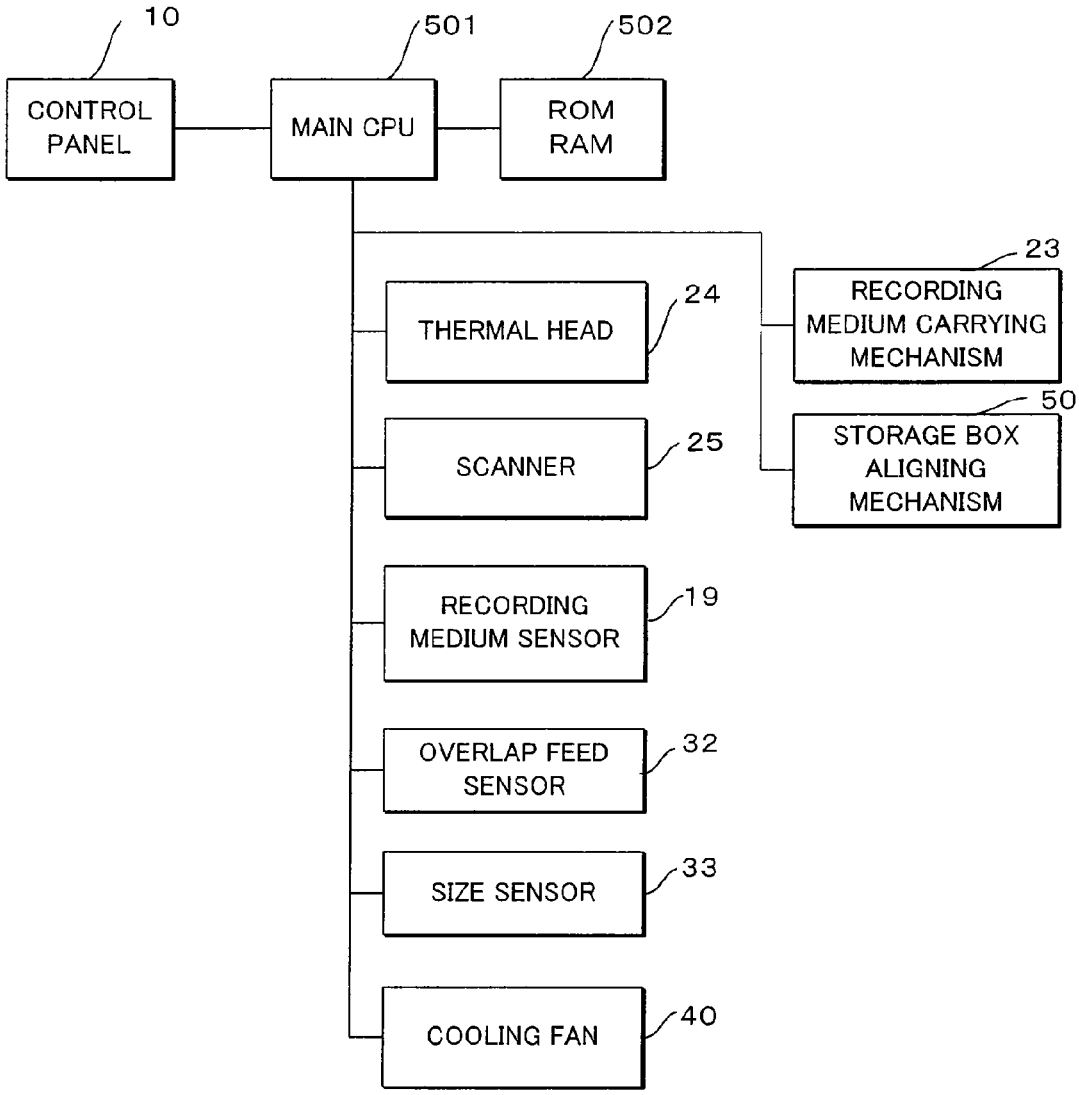
FIG. 5 is a block diagram illustrating a configuration of the image erasing apparatus according to the embodiment of the invention.

FIG. 5 is a block diagram illustrating the configuration of the image erasing apparatus 1. As shown in FIG. 5, the image erasing apparatus 1 includes a main CPU 501 as a controller. The main CPU 501 is connected to the control panel 10 and a ROM and RAM 502 as a memory device.

The main CPU 501 is also connected to the thermal head 24, the scanner 25, the recording medium sensor 19, the overlap feed sensor 32, the size sensors 33, and the cooling fan 40.

The main CPU 501 controls the recording medium carrying mechanism 23 and the storage box aligning mechanisms 50.

The main CPU 501 controls ON and OFF of the thermal head 24 and the temperature thereof. The main CPU 501 controls ON and OFF of the cooling fan 40 and the number of revolutions thereof.

Advantages

As described above, the image erasing apparatus 1 according to this embodiment includes the stacking tray 16 stacking the recording medium, the heater heating the recording mediums to a temperature equal to or higher than the temperature at which developer on the recording mediums is erased, the detector disposed downstream in a recording medium carrying direction from the heater to detect the images on the recording mediums, the recording medium carrying mechanism 23 picking up the recording mediums from the stacking tray 16 sheet by sheet and carrying the picked-up recording mediums, the storage boxes 40A, 40B, 40C, and 40D storing the image-erased recording mediums by size, the lateral aligning mechanism 50A disposed in the storage box so as to align the recording medium in the lateral direction, and the controller controlling the alignment operation of the lateral aligning mechanism 50A.

Therefore, it is possible to align and receive image-erased recording mediums.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image erasing apparatus for erasing an image on a sheet, comprising:

a sheet supplying unit configured to supply a sheet having an image formed with an erasable material that is erased when heated to a temperature that is equal to or higher than an erasing temperature of the erasable material;

a sheet conveying unit configured to convey the sheet from the sheet supplying unit;

a heater configured to heat the sheet to a temperature equal to or higher than the erasing temperature;

a storage portion configured to store the sheet;

a longitudinal aligning portion configured to contact a leading end of the sheet conveyed to the storage portion;

a first lateral aligning portion and a second lateral aligning portion configured to align the sheet by receiving the sheet therebetween;

a driving unit configured to drive at least one of the first lateral aligning portion and the second lateral aligning portion in a lateral width direction of the sheet to align the sheet laterally; and a controller configured to control the driving unit when the sheet is conveyed to the storage portion.

2. The apparatus according to claim 1, wherein the controller controls the driving unit to displace the first lateral aligning portion and the second lateral aligning portion so as to produce a gap therebetween that is greater than a lateral width of the sheet when the sheet is conveyed to the storage portion.

3. The apparatus according to claim 2, wherein the driving unit is configured to drive the first lateral aligning portion and the second lateral aligning portion at the same time.

4. The apparatus according to claim 2, wherein at least one of the first lateral aligning portion and the second lateral aligning portion is driven multiple times to align the sheet laterally.

5. The apparatus according to claim 2, further comprising:

a scanner disposed downstream of the heater that is configured to scan the sheet; and a reject portion separate from the storage portion, wherein the controller determines the presence of the image on the sheet according to an output of the scanner and, when the controller determines that the image on the sheet is present, the controller controls the sheet conveying unit to convey the sheet to the reject portion and, when the controller determines that no image on the sheet is present, the controller controls the sheet conveying unit to convey the sheet to the storage portion.

6. The apparatus according to claim 5, further comprising:

a plurality of storage portions, wherein the controller controls the sheet conveying unit to convey the sheet to one of the storage portions according to a size of the sheet.

7. The apparatus according to claim 6, further comprising:

a longitudinal driving unit configured to drive the longitudinal aligning portion;

wherein the controller controls the longitudinal driving unit to displace the longitudinal aligning portion so as to produce a sheet receiving area having a longitudinal dimension that is greater than a longitudinal dimension of the sheet when the sheet is conveyed to the storage portion.

8. The apparatus according to claim 2, further comprising:

a plurality of storage portions;

wherein the controller controls the sheet conveying unit to convey the sheet to one of the storage portions according to a size of the sheet.

9. The apparatus according to claim 2, further comprising:

a longitudinal driving unit configured to drive the longitudinal aligning portion along a sheet conveying direction;

wherein the controller controls the longitudinal driving unit to displace the longitudinal aligning portion so as to produce a sheet receiving area having a longitudinal dimension that is greater than a longitudinal width of the sheet when the sheet is conveyed to the storage portion.

10. A conveying method of an image erasing apparatus for erasing an image on a sheet, the method comprising:

conveying a sheet from a sheet supplying unit, the sheet having an image formed with an erasable material that is erased when heated to a temperature that is equal to or higher than an erasing temperature of the erasable material;

heating the conveyed sheet to a temperature equal to or higher than the erasing temperature;

stacking the heated sheet in a stacking portion;

striking a leading end of the stacked sheet with a longitudinal aligning portion; and driving at least one of a first lateral aligning portion and a second lateral aligning portion in a lateral width direction of the stacked sheet using a driving unit to align the stacked sheet laterally between the first lateral aligning portion and the second lateral aligning portion.

11. The method according to claim 10, further comprising displacing the first lateral aligning portion and the second lateral aligning portion so as to produce a gap therebetween that is greater than a lateral width of the heated sheet when the heated sheet is conveyed to the stacking portion.

12. The method according to claim 11, further comprising driving the first lateral aligning portion and the second lateral aligning portion at the same time.

13. The method according to claim 11, further comprising driving at least one of the first lateral aligning portion and the second lateral aligning portion multiple times to align the heated sheet laterally.

14. The method according to claim 11, further comprising:

scanning the heated sheet by a scanner disposed downstream of the heater;

detecting whether the image is present on the heated sheet according to the output of the scanner;

conveying the heated sheet to a reject portion separate from the stacking portion if the image on the heated sheet is detected; and conveying the heated sheet to the stacking portion if no image is detected on the heated sheet.

15. The method according to claim 14, further comprising:

conveying the heated sheet to one of a plurality of stacking portions according to a size of the heated sheet.

16. The method according to claim 15, further comprising:

displacing the longitudinal aligning portion so as to produce a sheet receiving area having a longitudinal dimension that is greater than a longitudinal dimension of the heated sheet when the heated sheet is conveyed to the stacking portion.

17. The method according to claim 11, further comprising:

conveying the heated sheet to one of a plurality of stacking portions according to the size of the heated sheet.

18. The method according to claim 11, further comprising:

displacing the longitudinal aligning portion so as to produce a sheet receiving area having a longitudinal dimension that is greater than a longitudinal dimension of the heated sheet when the heated sheet is conveyed to the stacking portion.

19. A sheet rejecting apparatus comprising:

a sheet supplying unit configured to supply a sheet;

a sheet conveying unit configured to convey the sheet from the sheet supplying unit;

a storage portion configured to store the sheet;

a longitudinal aligning portion configured to contact a leading end of the sheet conveyed in the storage portion;

a first lateral aligning portion and a second lateral aligning portion configured to align the sheet by receiving the sheet therebetween;

a driving unit configured to drive at least one of the first lateral aligning portion and the second lateral aligning portion in a lateral width direction of the sheet to align the sheet laterally;

a controller configured to control the driving unit when the sheet is conveyed to the storage portion.

20. The apparatus according to claim 19, wherein the controller controls the driving unit to displace the first lateral aligning portion and the second lateral aligning portion so as to produce a gap therebetween that is greater than a lateral width of the sheet when the sheet is conveyed to the storage portion.

21. The apparatus according to claim 20, wherein the driving unit is configured to drive the first lateral aligning portion and the second lateral aligning portion at the same time.

22. The apparatus according to claim 20, further comprising:

a scanner configured to scan an image on the sheet; and a reject portion separate from the storage portion, wherein the controller determines the presence of the image on the sheet according to an output of the scanner and, when the controller determines that the image on the sheet is present, the controller controls the sheet conveying unit to convey the sheet to the reject portion and, when the controller determines that no image on the sheet is present, the controller controls the sheet conveying unit to convey the sheet to the storage portion.

* * * * *